US011357327B2

(12) United States Patent
Marriott et al.

(10) Patent No.: US 11,357,327 B2
(45) Date of Patent: Jun. 14, 2022

(54) COMPONENT FOR A STORAGE SYSTEM

(71) Applicant: SUPPLY POINT SYSTEMS LIMITED, Rugby (GB)

(72) Inventors: Christopher Marriott, Rugby (GB); Iain Clark, Rugby (GB); Rafael Veiga, Rugby (GB); Christopher Benwell, Rugby (GB)

(73) Assignee: Supply Point Systems Limited

( * ) Notice: Subject to any disclaimer, the term of this patent is extended or adjusted under 35 U.S.C. 154(b) by 0 days.

(21) Appl. No.: 16/964,077

(22) PCT Filed: Jan. 22, 2019

(86) PCT No.: PCT/GB2019/050170
§ 371 (c)(1),
(2) Date: Jul. 22, 2020

(87) PCT Pub. No.: WO2019/145698
PCT Pub. Date: Aug. 1, 2019

(65) Prior Publication Data

US 2021/0045532 A1 Feb. 18, 2021

(30) Foreign Application Priority Data

Jan. 23, 2018 (GB) ..... 1801047

(51) Int. Cl.
*G07F 11/62* (2006.01)
*A47B 96/20* (2006.01)
*G07F 17/00* (2006.01)

(52) U.S. Cl.
CPC ..... *A47B 96/20* (2013.01); *G07F 11/62* (2013.01); *G07F 17/0092* (2013.01)

(58) Field of Classification Search
CPC ..... A47B 96/00; A47B 96/20; G07F 7/0092; G07F 11/62
USPC ..... 312/107
See application file for complete search history.

(56) References Cited

U.S. PATENT DOCUMENTS

| | | | |
|---|---|---|---|
| 2,704,699 | A | 3/1955 | Evans |
| 3,231,785 | A | 1/1966 | Calabro |
| 4,049,154 | A | 9/1977 | Burks |
| 4,866,576 | A | 9/1989 | Umetsu et al. |
| 5,524,775 | A | 6/1996 | Kaine |
| 5,590,939 | A | 1/1997 | Piontek |

(Continued)

FOREIGN PATENT DOCUMENTS

| | | | |
|---|---|---|---|
| DE | 3841653 | A1 | 6/1990 |
| EP | 3098787 | A1 | 11/2016 |
| GB | 1230138 | | 4/1971 |

OTHER PUBLICATIONS

Great Britain Search Report for Great Britain Application No. GB18001047.0, dated Jul. 24, 2018, 8 pages.

(Continued)

*Primary Examiner* — James O Hansen
(74) *Attorney, Agent, or Firm* — RatnerPrestia

(57) ABSTRACT

A cover for a support beam in a storage system includes a plate; an abutment portion extending upwards from the plate; and a guide projection formed on the upper surface of the plate and extending at an angle to the abutment portion. The plate further includes at least one positioning projection formed in a side of the plate and extending along the guide projection.

12 Claims, 6 Drawing Sheets

(56) References Cited

U.S. PATENT DOCUMENTS

| | | | | |
|---|---|---|---|---|
| 2003/0116515 | A1 | 6/2003 | Ureshino | |
| 2004/0200853 | A1 | 10/2004 | Prichard | |
| 2006/0009121 | A1 | 1/2006 | Rotundo et al. | |
| 2007/0093092 | A1 | 4/2007 | Fang | |
| 2010/0135022 | A1* | 6/2010 | Deguara ..... | H01R 13/73 362/249.06 |
| 2014/0229003 | A1 | 8/2014 | Stoffel et al. | |

OTHER PUBLICATIONS

International Search Report and Written Opinion for International Application PCT/GB2019/050170, dated Apr. 17, 2019, 9 pages.
European Search Report for European Application No. 19/02667.7, dated Feb. 8, 2022, 6 pages.

* cited by examiner

COMPONENT FOR A STORAGE SYSTEM

CROSS REFERENCE TO RELATED APPLICATIONS

This is a U.S. National Phase application of PCT/GB2019/050170, filed Jan. 22, 2019, which claims priority to Great Britain Patent Application No. 1801047.0, filed Jan. 23, 2018, the disclosures of each of these applications being incorporated herein by reference in their entireties for all purposes.

FIELD OF THE INVENTION

The present invention relates to an assembly of a storage system. In one aspect, it relates to a cover for mounting on a support beam in stock control systems well-known for use, for example, in manufacturing and medical facilities or as vending machines.

BACKGROUND OF THE INVENTION

In typical automated stock control systems, a storage cabinet comprises a plurality of latched drawers held between panels fixed between support beams. Articles to be supplied to users are provided in the drawers or compartments of the drawers. Examples of such articles include cutting tools and the like used with machine tools; other manufacturing tools and components; drugs, needles and other medical items; and legal documents. A control system allows a user to access the required article by unlatching the drawer containing the required article. The drawer is then pulled out from the home position (where no compartments are exposed) to the extent that the compartment containing the article is exposed, when the drawer is latched again to prevent further opening of the drawer.

In a known system, each panel includes a control mechanism for the drawers. The control mechanism on all panels is centrally connected to a system controller by means of cabling. The cabling runs along the surface of the support beams between the panels. At the time of assembly or re-configuring of the system, the panels may be added or moved from one point to another along the support beams. To mount a panel between an upper and a lower support beam, it is necessary to hold the panel above the cabling so that it aligns with engagement extensions provided on the support beams. Once aligned, a screw is inserted through a hole at the top of the panel to fix it to the engagement section in the upper beam and a screw is then inserted at the bottom of the panel to fix it to the bottom support beam. Understandably, this is very fiddly and can lead to the cabling becoming damaged. When there are several beams and several levels of panels within the cabinet, the task of assembling can become cumbersome.

Moreover, as the panels can easily misalign with respect to the support beams during mounting, it is very difficult for a single person to keep them aligned while fixing the screws. Therefore, to carry out the task efficiently, two people are needed in the existing system.

SUMMARY OF THE INVENTION

The present invention has been made to address the problems of the prior art system. According to an aspect of the present invention, there is provided a cover for a support beam comprising: a plate; an abutment portion extending upwards from the plate; and a guide projection formed on the upper surface of the plate and extending at an angle to the abutment portion.

Advantageously, such a cover when mounted on a support beam in a storage system aids in assembling the storage system by allowing a panel to be fitted between the support beams via the guide projection formed on the cover. Moreover, the cover protects the surface of the support beam from damage during assembly.

Preferably, the plate further comprises at least one positioning projection formed in a side of the plate and extending along the guide projection.

Preferably, the plate further comprises a line of weakness extending along the surface of the plate, between the abutment portion and the guide projection, such that the plate can be broken into two parts along the line of weakness.

Preferably, the plate further comprises a fixing hole formed in the plate adjacent the line of weakness.

Preferably, the plate further comprises at least one engagement protrusion, extending outwards from a side of the plate, adapted to engage with the back of the support beam.

Preferably, the plate further comprises a cabling hole formed in the plate, wherein the cabling hole is adapted to allow a cable with a plug to pass through.

Preferably in that, the plate further comprises a plug socket formed in the plate such that the plug can fit into the plug socket.

According to another aspect of the invention, there is provided a system comprising: a panel adapted to be mounted between a first support beam and a second support beam; and the cover as described above adapted to be mounted on the surface of the support beams.

Preferably, the panel is adapted to slide onto the cover mounted on the first support beam along the guide projection such that the top end of the panel abuts the positioning projection formed in the cover mounted on the second support beam; and the panel is further adapted to abut the abutment portion formed in an adjacent cover when the panel is turned in a direction away from the guide projection.

Preferably, the panel comprises engagement extensions adapted to engage with corresponding fixing tabs on the support beams upon turning the panel onto the cover mounted on the first support beam.

Preferably, the panel further comprises a guide block on one side and a support on the other side.

Preferably, the panel is adapted to hold a storage unit between the guide block on one side of the panel and the support on the other side of an adjacent panel.

Preferably, the guide block comprises means for controlling and monitoring the movement of the storage unit.

Preferably in that, the guide block is adapted to connect to a controller through cabling running along the surface of the support beams, and the cover is adapted to cover the cabling on the surface of the support beams.

According to another aspect of the invention, there is provided a support beam comprising: a base plate; at least one abutment portion extending upwards from the base plate; and at least one guide projection formed on the upper surface of the base plate and extending at an angle to the abutment portion.

Preferably, the base plate further comprises at least one positioning projection formed in a side of the base plate and extending along the guide projection.

According to yet another aspect of the invention, there is provided a method of fixing a panel between a first support beam and a second support beam, the method comprising:

mounting one or more covers on the surface of the support beams; sliding the panel along a guide projection, formed in the cover mounted on the first support beam; rotating the panel in a direction away from the guide projection until it abuts an abutment portion formed in an adjacent cover such that engagement extensions formed in the panel aligns with corresponding engagement features formed in the support beams; and fixing the panel to the support beams by fastening means.

BRIEF DESCRIPTION OF THE DRAWINGS

Embodiments of the present invention will now be described by way of example only and with reference to the accompanying drawings, in which.

DETAILED DESCRIPTION OF EMBODIMENTS OF THE INVENTION

In the following specification, the terms front, back, rear, left, right, top, bottom, upper, lower and like terms will be used consistently with the arrangement shown in FIG. 1. In particular, the expression height corresponds to a dimension from top to bottom, width corresponds to a dimension from left to right and depth corresponds to a dimension from front to back. However, it is not limited to this orientation.

Figure 1:
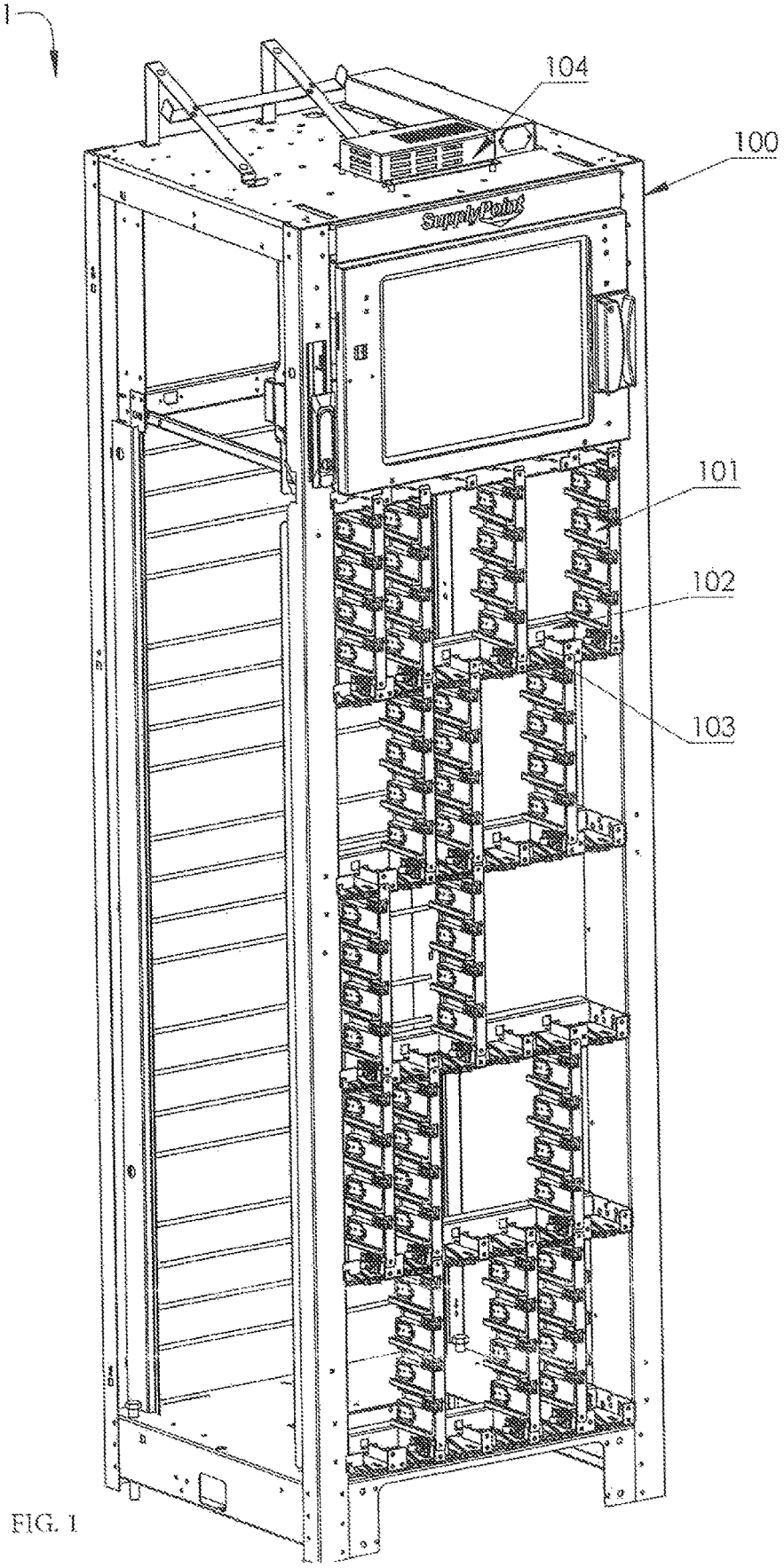
FIG. 1 is a perspective view of a storage system according to an aspect of the present invention.

FIG. 1 shows a perspective view of a storage system 1 according to the present invention. In the system 1, a housing 100 is provided with a frame comprising a plurality of panels 101 held upright between a plurality of support beams 102 extending in the width direction of the housing 100. The panels 101 and the support beams 102 are positioned such that several drawers (not shown) stacked on top of each other can be held between two adjacent panels 101. The system 1 has a modular design, therefore it can be configured to hold as many drawers of variable size as desired. The panels 101 can be fixed at different points on the support beams 102 to accommodate drawers of single, double, or triple width and/or height. The support beams 102 are each provided with a plurality of covers 103 mounted on the surface of each of the support beams 102. These covers 103 provide support for fixing the panels 101 between the support beams 102 (described in more detail below).

The housing 100 also has a system controller 104 mounted thereto. Cabling may extend from the system controller 104 down to the side of the storage system 1 and along the support beams 102 to a circuit board provided in each of the panel 101. Although not shown, side and back plates are mounted to the housing 100 to prevent unauthorised access to the drawers and any control electronics.

Figure 2:
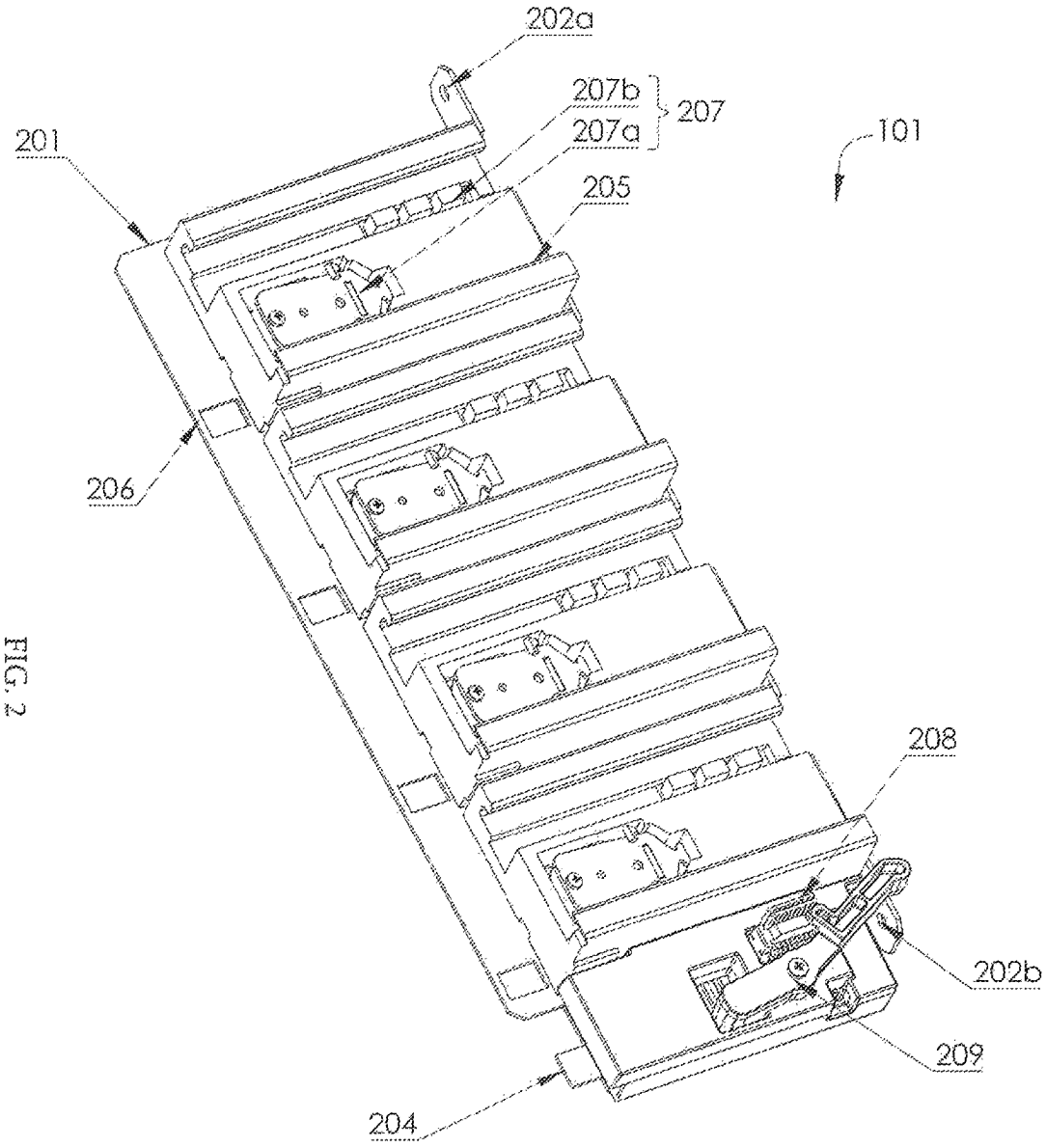
FIG. 2 is a perspective view of a panel in the storage system shown in FIG. 1.

FIG. 2 shows a detailed view of the panel 101. In the present embodiment, the panel 101 comprises an upright 201, which is substantially L-shaped in cross-section and is formed by a front plate extending in the width direction and back plate extending in the depth direction. The top and bottom ends of the panel 101 have engagement extensions 202*a*, 202*b* to engage with the support beams 102. The panel also includes a hook 204 at the bottom of its back surface to abut the back of the support beam 102.

The panel 101 further comprises guide blocks 205 for holding drawers in a stacked arrangement with the drawers stacked above one another. As shown in FIG. 2, each panel 101 can hold up to four drawers arranged above one another on four guide blocks 205. The panel 101 also includes corresponding supports 206 (see FIG. 5) provided on the other side of the panel 101. A drawer is held between two adjacent panels 101 such that it is supported by the guide block 205 on the right-hand side panel 101 and the corresponding support 206 on the adjacent left-hand side panel 101 (as shown in FIG. 1). Furthermore, the panel 101 includes control means 207 comprising a latch mechanism 207*a* and sensors 207*b*. In the present embodiment, a solenoid and a solenoid flap constitute the latch mechanism 207*a* and a group of LEDs and light receivers constitute the sensors 207*b*. The latch mechanism 207*a* and the sensors 207*b* protrude through windows provided in the guide block 205. The control means 207 monitors when the drawer is in its fully closed position, the distance the drawer moves, and the direction of movement of the drawer. The control means 207 is connected to the system controller 104 through cabling connected to a control port 208.

The panel 101 is also provided with a manual latch override system activated by an override handle 209 pivotally mounted to an over-ride bar (not shown). By depressing the override handle 209, the over-ride bar is lifted to unlatch all latch mechanism 207*a* mounted to the panel 101.

The use of latch mechanism and sensors to monitor the movement of the drawers is well known in the art. Also, it is to be understood that any suitable control means may be used for the same purpose.

Figure 3:
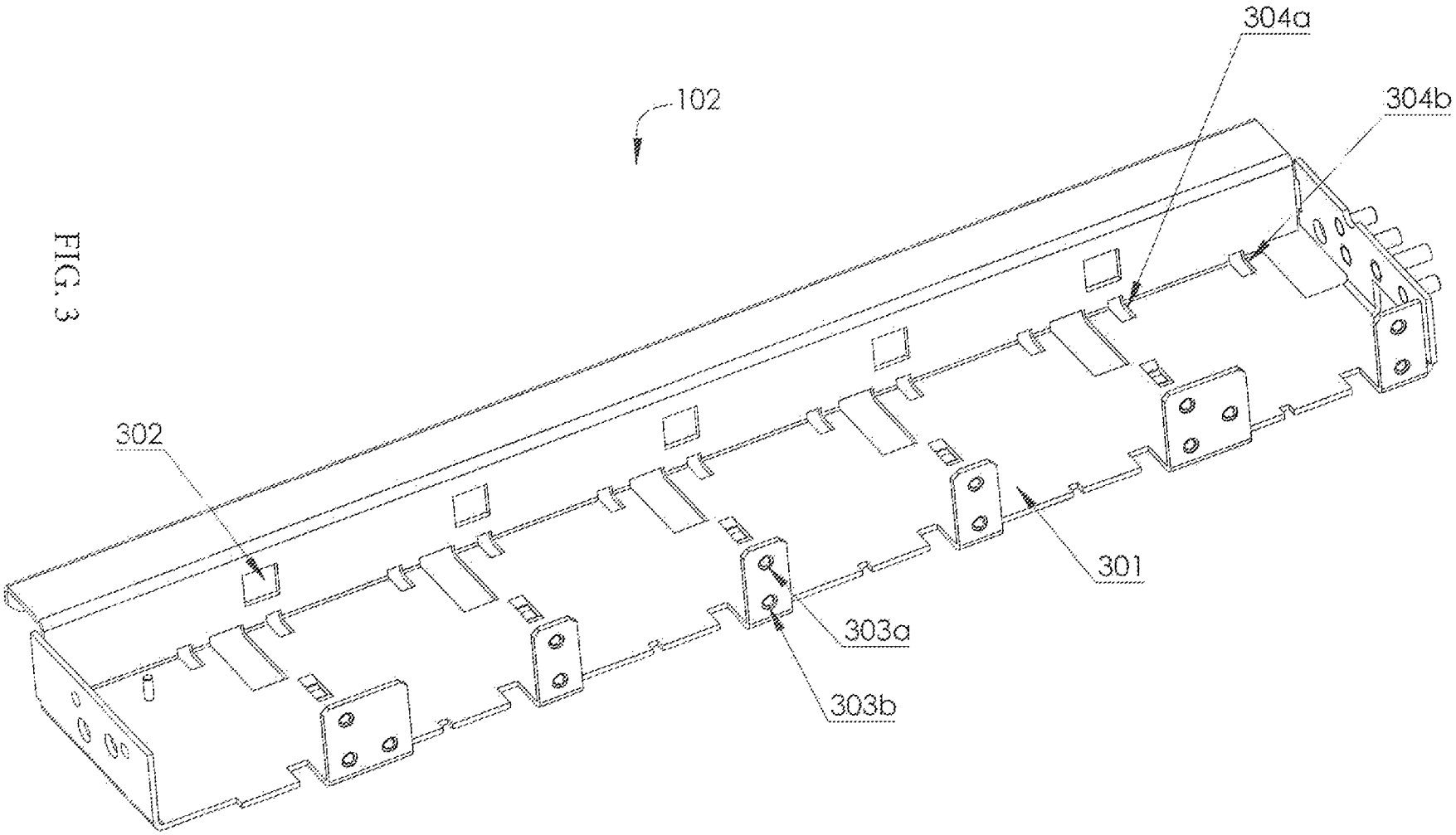
FIG. 3 is a perspective view of a support beam in the storage system shown in FIG. 1.

FIG. 3 shows a detailed view of the support beam 102. In the present embodiment, the support beam 102 comprises a horizontal base plate 301 with an upright back wall and upright side walls. Location holes 302 are formed in the back wall at predetermined intervals. At corresponding intervals, fixing tabs 303 project upwards from the front edge of the base plate 301. Each of the fixing tabs 303 is provided with at least two mounting holes 303*a*, 303*b*. The panel 101 abuts the support beam 102 by engaging the hook 204 at the bottom of its back surface with a respective location hole 302. A screw or a bolt is passed through the lower engagement extension 202*b* at the bottom end of the panel 101 and the upper mounting hole 303*a* of the corresponding fixing tab 303 in a lower support beam 102. The top of the panel 101 is fixed to an upper support beam 102 by passing a screw or a bolt through the upper engagement extension 202*a* at the top end of the panel 101 and the lower mounting hole 303*b* of the corresponding fixing tab 303 of the upper support beam 102.

Figure 4:
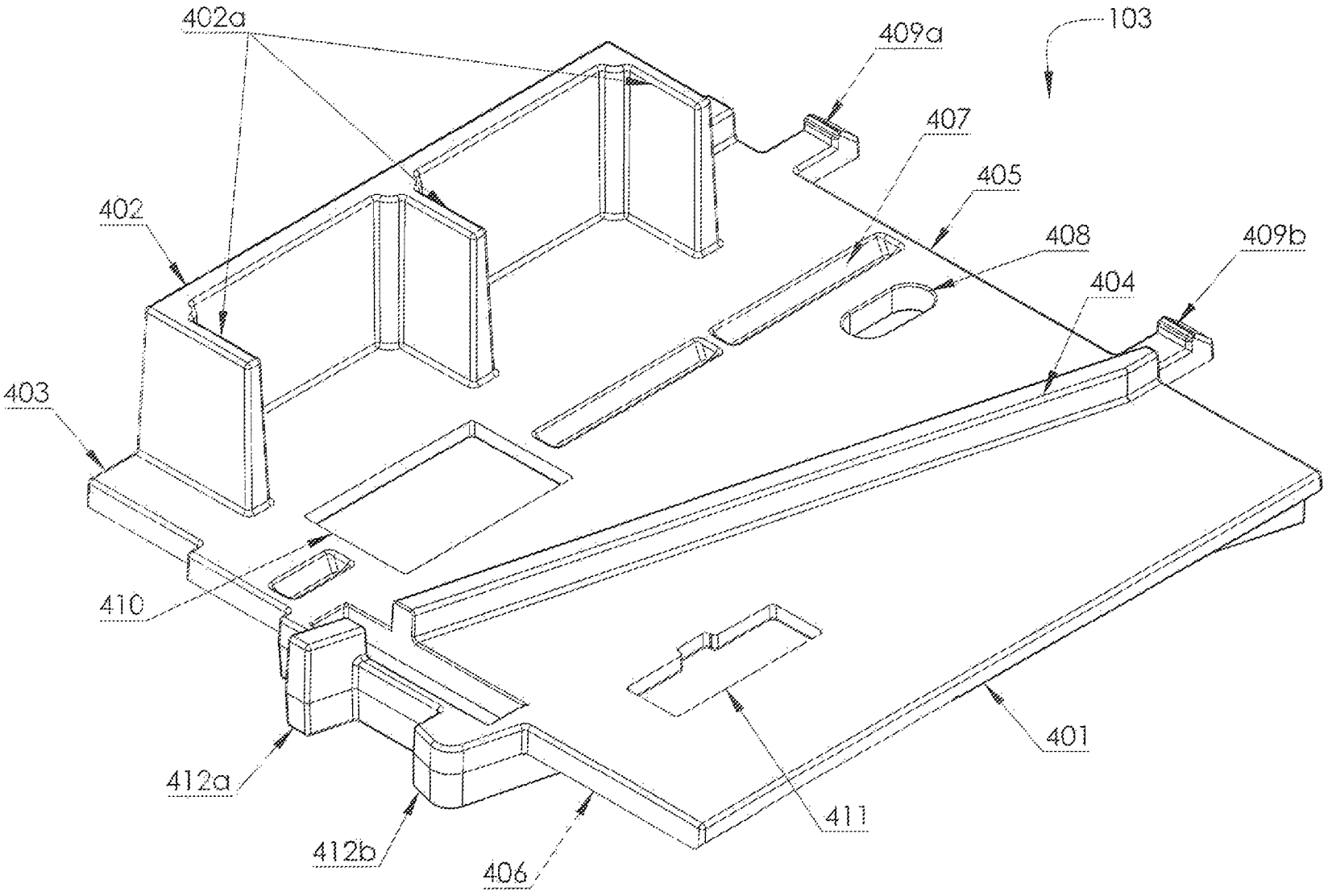
FIG. 4 is a perspective view of a cover for a support beam in the storage system shown in FIG. 1.

FIG. 4 shows a perspective view of the cover 103 for the support beam 102. In one embodiment, the cover 103 comprises a plate 401, which is substantially rectangular and is formed as a unitary component. It is to be understood that the plate 401 can be of any suitable shape and formed of any material. The plate 401 has an abutment portion 402 formed along one side 403 of the plate 401. The abutment portion 402 extends upwards from the side 403 of the plate 401 up to a few centimeters in height. The abutment portion 402 has reinforcement sections 402*a* projecting outwards from the inner surface of the abutment portion 402 and meeting the surface of the plate 401. The abutment section 402 can be formed on any other side or on the surface of the plate 401, and can extend either along the entire side or part-way along it, for example along the middle. The abutment portion 402 could also be formed as two separate walls on either ends of the side 403. It is to be noted that the reinforcement sections 402*a* are optional and the abutment portion 402 may be strengthened by other means.

The plate 401 further comprises a guide projection 404 formed on the surface of the plate 401. In the present embodiment, the guide projection 404 protrudes outwards from the surface of the plate 402 and extends as a thin strip along the surface of the plate 401. The guide projection 404 lies at an angle to the abutment portion 402 such that it slopes down towards the front face of the abutment portion 402. In other words, the guide projection 404 extends diagonally along the surface of the plate 401 between sides 405 and 406.

The plate 401 also comprises a line of weakness 407 formed on the surface of the plate 401 and disposed between the abutment portion 402 and the guide projection 404. In the present embodiment, the line of weakness 407 is formed adjacent the side 403 and extends orthogonally between the sides 405 and 406 of the plate 401. The line of weakness 407 can be made by slicing out some material from the surface of the plate 401 or by any other surface weakening method. The strength of the plate 401 along the line of weakness 407 is substantially lower than the rest of the plate so that it can be easily broken off along the line of weakness 407 to split the plate 401 into two parts. The plate 401 further comprises a fixing hole 408 formed in the surface of the plate 401 adjacent the line of weakness 408 and between the line of weakness 407 and the guide projection 404.

The plate 401 further comprises engagement protrusions 409 extending outwards from a side of the plate 401. In the present embodiment, two engagement protrusions 409*a*, 409*b* are formed along the side 405. The engagement protrusion 409*a* is formed adjacent the abutment portion 402 and the engagement protrusion 409*b* is formed adjacent the guide projection 404. The positioning of the engagement protrusions 409*a*, 409*b* is such that when the plate 401 is broken into two parts along the line of weakness 407, the engagement extension 409*b* and the fixing hole 408 are contained in the part having the guide projection 404 and the engagement protrusion 409*a* is contained in the part having the abutment portion 402. It is to be understood that the fixing hole 408 and/or the engagement protrusions 409 are optional, and other engagement means can be provided in the plate 401.

The plate 401 further comprises a cabling hole 410 formed as a cut-through section in the plate 401. In the present embodiment, the cabling hole 410 is disposed between the abutment portion 402 and the guide projection 404 and astride the line of weakness 407. The cabling hole 410 is dimensioned such that a cabled plug can pass through it. The plate 401 also comprises a plug socket 411 which is also formed as a cut-through section in the plate 401. In the present embodiment, the plug socket 411 is disposed adjacent the guide projection 404 and in line with the cabling hole 410. The plug socket 411 is dimensioned such that it hold the cabled plug drawn out of the cabling hole 410.

Furthermore, the plate 401 comprises positioning projections 412*a*, 412*b* formed in the plate 401. In the present embodiment, the positioning projection 412*a* extends in the same line as the guide projection 404 and the positioning projection 412*b* formed at a short distance apart. The positioning projections 412*a*, 412*b* are formed such that when the plate 401 is broken along the line of weakness 407, the positioning projections 412*a*, 412*b* are contained in the part having the guide projection 404.

A plurality of covers 103 are mounted onto the support beams 102*a*, 102*b* to cover the upper surfaces of the support beams 102. The cover 103 is pushed onto the support beam 102, between the adjacent fixing tabs 303, until the engagement protrusions 409*a*, 409*b* engage with corresponding engagement notches 304*a*, 304*b* formed in the support beam 102. The engagement protrusions 409 have sloped edges (as shown in FIG. 4) which allow them to easily slide into the engagement notches 304 and once engaged they are firmly locked in place. The covers 103 are mounted over the cabling (not shown) that runs along the upper surface of each support beam 102 to protect it. Cabling attached to a plug is pulled out through the cabling hole 410. Underside of each cover 103 is provided with projections or cable guides to prevent the cover 103 from resting directing onto the cabling.

Figure 5:
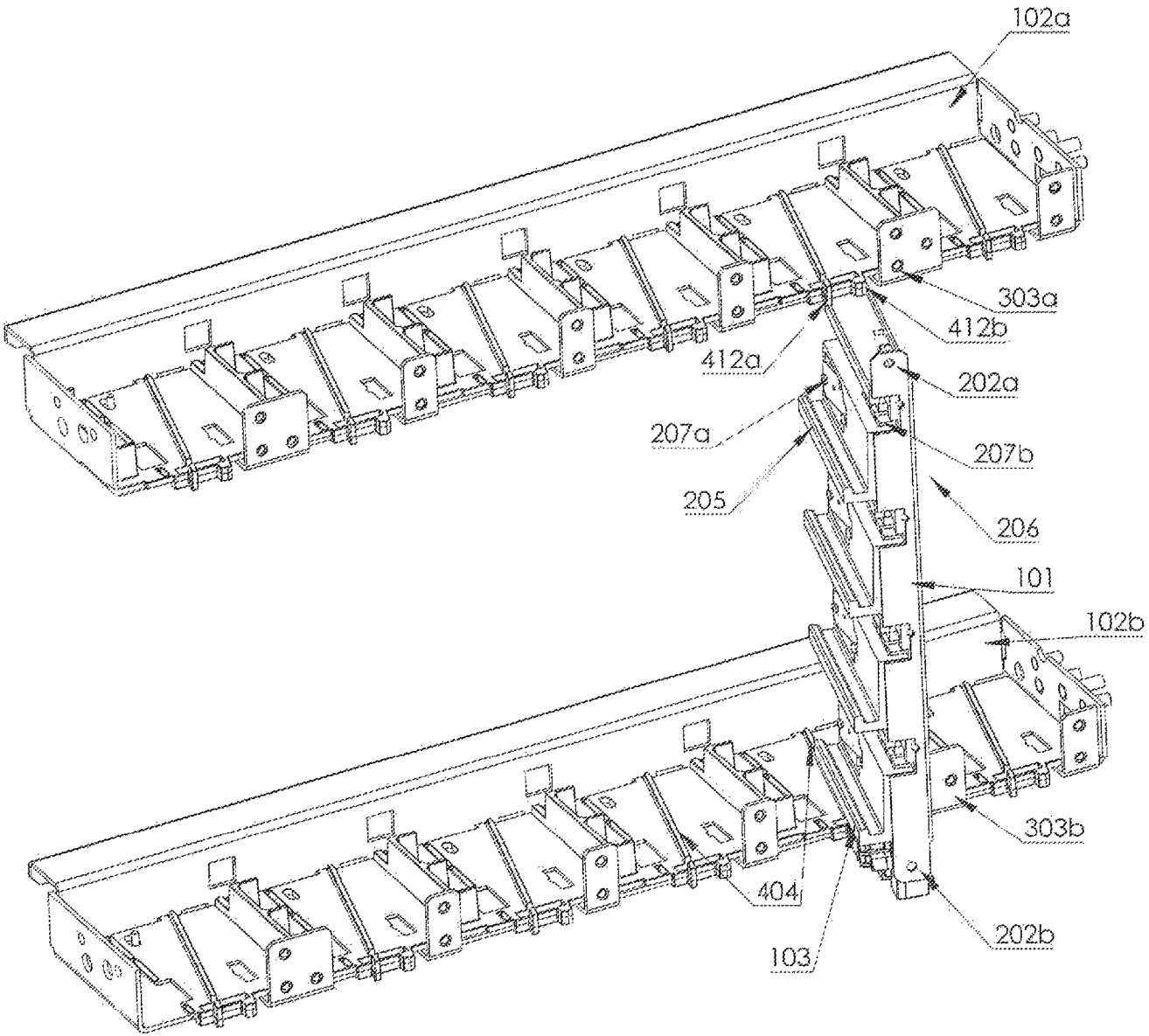
FIG. 5 is a perspective view of a panel being mounted between two support beams in the storage system of FIG. 1.

One or more panels 101 are fitted between the support beams 102 after the covers 103 are mounted on both the upper support beam 102*a* and the lower support beam 102*b*. FIG. 5 shows the panel 101 being inserted between the upper support beam 102*a* and the lower support beam 102*b* onto the surface of the cover 103 mounted on the lower support beam 102*b*. In the present embodiment, the panel 101 is slid onto the cover 103 mounted on the lower support beam 102*b* along the guide projection 404. The guide projection 404 provides a mounting guide for the bottom end of the panel 101.

Figure 6:
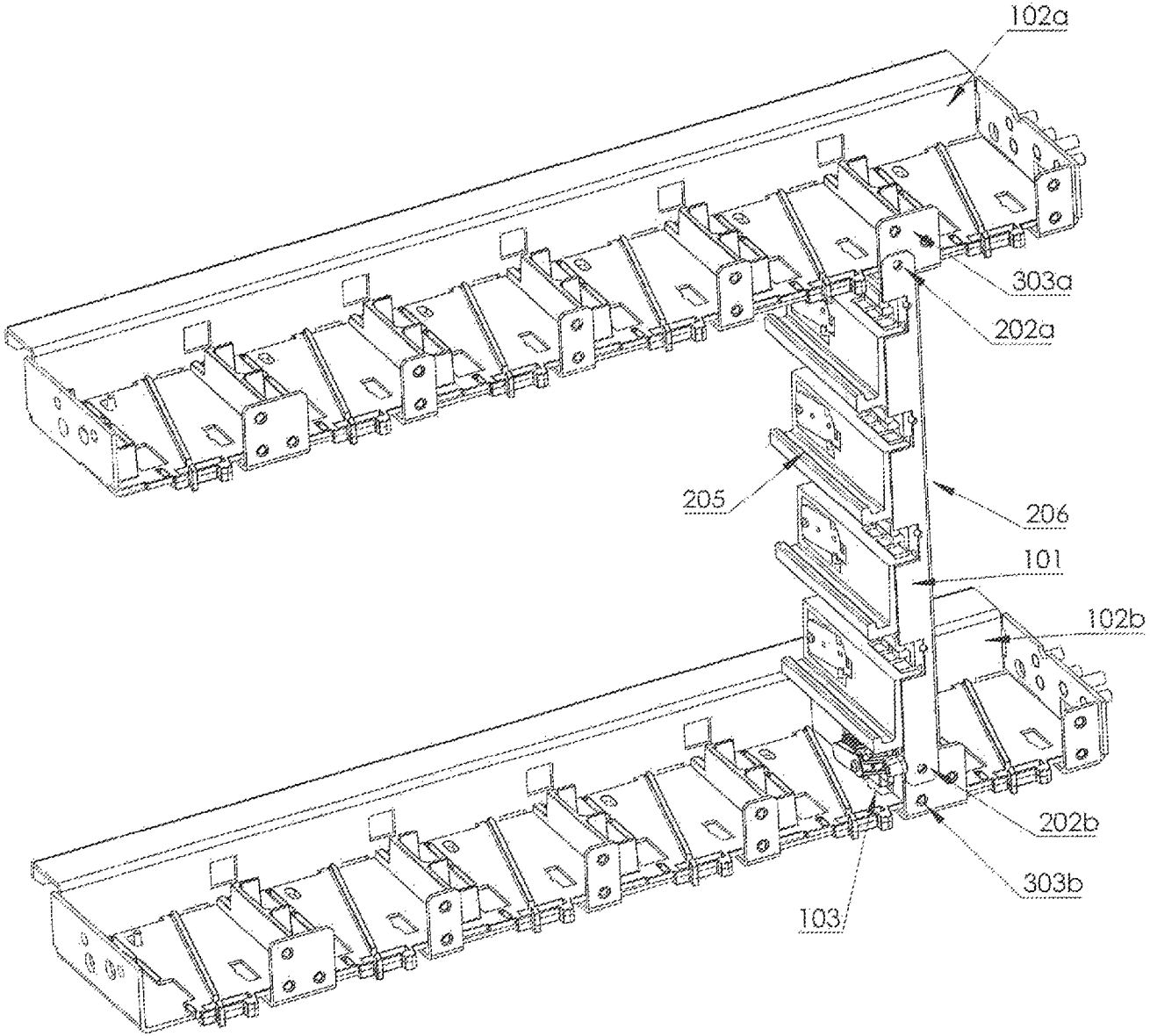
FIG. 6 is a perspective view of the panel aligned between the two support beams.

To fit the panel 101 between the support beams 102*a*, 102*b*, the panel 101 is aligned such that the upper part of the panel 101 which extends above the topmost guide block 205 is in contact with the positioning projections 412*a*, 412*b* on the upper support beam 102*a*, and the bottom face of the panel 101 below the lowermost guide block 205 is in contact with the top face of the cover 103 on the lower support beam 102*b*. The lower left side face of the panel 101 remains in contact with the guide projection 404 on the cover 103. The panel 101 is then slid inwards at an angle along the right-hand side of the guide projection 404 on the cover 103 such that the top engagement extension 202*a* of the panel 101 abuts the positioning projections 412*a*, 412*b*. Since the guide projection 404 slopes to the left-hand side of a user facing the unit, the user can easily slide the panel 101 along the guide projection 404 using his left hand, maintaining the contact until the lower back of the panel 101 abuts the back of the support beam 102*b*. The user can then use his left hand to turn the panel 101 to the right, using the back of the panel 101 as a pivot point, until the rear of the panel 101 hits the left-hand side of the abutment portion 402 formed in an adjacent cover 103. With this, the top and the bottom engagement extensions 202*a*, 202*b* of the panel 101 are positioned over and aligned with the corresponding fixing tabs 303*a*, 303*b* in the upper and lower support beams 102*a*, 102*b* (as shown in FIG. 6). The user can then fit screws or bolts through these holes using his right hand.

In this way, the panel 101 is easily positioned and fixed between the support beams 102*a*, 102*b*, without damaging the cabling. After fixing the panel 101, the cabled plug that has been fed though the cabling hole 410 can then be connected to the control port 208 provided at the bottom of the panel 101.

The leftmost covers 103 do not need to provide an abutment for a further panel 101 to the left. To save space, therefore, the left-hand side of the leftmost cover 103 can be broken off along the line of weakness 407. When the cover 103 is split into two parts, the part containing the abutment portion 402 is discarded. However, this leads to loss of the engagement protrusion 409*a*. Therefore, the fixing hole 408 is provided to allow a screw fixing to the support beam 102 as an additional way of fixing in the absence of the removed engagement protrusion 409*a*.

The storage system 1 is configurable to hold drawers of different sizes. When a double or triple width drawer is being fitted, the covers 103 are still fitted without gaps all the way along the support beams 102. However, no panel 101 is fitted to at least one of the covers 103. Moreover, for consistency of assembly and to assist with further in-field reconfiguration, unused cabling is still pulled though the cabling hole 410 of the unused cover 103. To prevent this unused cabling with the plug from interfering with the running of the bottom drawer, the plug is fitted into the plug socket 411 in the cover 103. This does not provide an electrical connection but only serves to hold the plug and the cabling away from the moving drawers above.

The use of the cover 103 on the support beam 102 in this manner provides significant advantages in terms of safety and convenience. For example, where a large unit with several levels of panels 101 are to be fixed between a plurality of support beams 102, it is possible to efficiently fit the panels 101 by placing them onto the covers 103 without having to worry about the cabling underneath. Moreover, a single person can alone fit a panel 101 between the support beams 102 because of the aid provided by the guide projection 404 and positioning projections 412*a*, 412*b* formed in the cover 103. This saves considerable manhours in configuring a unit and overall makes the process much more efficient and less likely to damage the cabling. Furthermore, by providing the line of weakness 407 in the cover 103, it is possible to use the same cover 103 for the leftmost section of the beam thereby saving space and manufacturing costs.

Those skilled in the art will recognise that the cover 103 of the present invention has a wide variety of different applications, from storage units to other systems where a panel is to be fixed between two beams. For example, such covers are suitable for use in modular telecoms equipment or power backup units.

The foregoing description has been given by way of example only and it will be appreciated by a person skilled in the art that modifications can be made without departing from the scope of the present invention.

The relative position of the panels 101 and the support beams 102 can be altered such the support beams are positioned vertically and the panels are held horizontally between the beams. Also, depending on the application, the panels may be held at an angle between the beams. In the cover 103, the use of reinforcement sections 402*a* on the abutment portion 402 are optional, so are the engagement protrusions 409*a* and fixing hole 408. Moreover, their respective dimensions, shape and positions in the cover 103 can be varied. For example, the abutment portion 402 could be made thicker or provided as a separate part fixed onto the cover 103 by fastening means. Also, instead of having the engagement protrusions 409, one or more fixing holes can be formed in the cover 103 to fix it to the support beam 102. Furthermore, it is also possible that the cover 103 is integral with the support beam 103. In that case, the features such as the guide projection 404 and the positioning projections 412 are provided on the base plate 301 itself. Moreover, there will be no need to form the features such as the line of weakness 407, the fixing hole 408, and the engagement protrusions 409.

The foregoing description of illustrated embodiments of the present invention, including what is described in the abstract, is not intended to be exhaustive or to limit the invention to the precise forms disclosed herein. While specific embodiments of the invention are described herein for illustrative purposes only, various equivalent modifications are possible within the scope of the present invention, as those skilled in the relevant art will recognise and appreciate. As indicated, these modifications may be made to the present invention in light of the foregoing description of illustrated embodiments of the present invention and are to be included within the scope of the present invention.

The invention claimed is:

1. A storage system comprising:

(i) a panel adapted to be mounted between a first support beam and a second support beam;

(ii) a first cover mounted on a surface of the first support beam; and (iii) a second cover mounted on a surface of the second support beam, each of the first and second covers comprising:

(a) a plate;

(b) an abutment portion extending upwards from the plate;

(c) a guide projection formed on an upper surface of the plate and extending at an angle to the abutment portion; and (d) at least one positioning projection formed in a side of the plate and extending along the guide projection, wherein the panel is adapted to slide onto the first cover mounted on the first support beam along the guide projection of the first cover such that a top end of the panel abuts the positioning projection formed in the second cover mounted on the second support beam, and wherein the panel is further adapted to abut the abutment portion formed in an adjacent cover, which is adjacent to the first cover, when the panel is turned in a direction away from the guide projection of the first cover.

2. The storage system according to claim 1, wherein the plate further comprises a line of weakness extending along the upper surface of the plate, between the abutment portion and the guide projection, such that the plate can be broken into two parts along the line of weakness.

3. The storage system according to claim 2, wherein the plate further comprises a fixing hole formed in the plate adjacent the line of weakness.

4. The storage system according to claim 1, wherein the plate further comprises at least one engagement protrusion, extending outwards from a side of the plate, adapted to engage with a back surface of the support beam.

5. The storage system according to claim 1, wherein the plate further comprises a cabling hole formed in the plate, wherein the cabling hole is adapted to allow a cable with a plug to pass through.

6. The storage system according to claim 5, wherein the plate further comprises a plug socket formed in the plate.

7. The storage system according to claim 1, wherein the panel comprises engagement extensions adapted to engage with corresponding fixing tabs on the first and second support beams upon turning the panel onto the first cover mounted on the first support beam.

8. The storage system according to claim 1, wherein the panel further comprises a guide block on one side and a support on the other side.

9. The storage system according to claim 8, wherein the panel is adapted to hold a storage unit between the guide block on one side of the panel and the support on the other side of an adjacent panel.

10. The storage system according to claim 9, wherein the guide block comprises means for controlling and monitoring the movement of the storage unit.

11. The storage system according to claim 10, wherein the means for controlling and monitoring the movement of the storage unit comprises a sensor.

12. The storage system according to claim 9, wherein the guide block is adapted to connect to a controller through cabling running along the surfaces of the first and second support beams, and the covers are adapted to cover the cabling on the surfaces the first and second support beams.

* * * * *